US010001346B2

(12) United States Patent
Augustine et al.

(10) Patent No.: US 10,001,346 B2
(45) Date of Patent: Jun. 19, 2018

(54) INFLATABLE BLAST-INDUCED BRAIN INJURY PREVENTION DEVICE

(71) Applicant: Augustine Biomedical and Design, LLC, Eden Prairie, MN (US)

(72) Inventors: Scott D. Augustine, Deephaven, MN (US); Ryan S. Augustine, Saint Louis Park, MN (US)

(73) Assignee: Augustine BioMedical and Design, LLC, Eden Prairie, MN (US)

( * ) Notice: Subject to any disclaimer, the term of this patent is extended or adjusted under 35 U.S.C. 154(b) by 168 days.

(21) Appl. No.: 14/968,409

(22) Filed: Dec. 14, 2015

(65) Prior Publication Data

US 2016/0169630 A1 Jun. 16, 2016

Related U.S. Application Data

(60) Provisional application No. 62/091,856, filed on Dec. 15, 2014.

(51) Int. Cl.

| | |
|---|---|
| ***F41H 1/00*** | (2006.01) |
| ***A41D 13/05*** | (2006.01) |
| ***A41D 13/018*** | (2006.01) |

(52) U.S. Cl.

CPC ..... *F41H 1/00* (2013.01); *A41D 13/018* (2013.01); *A41D 13/0512* (2013.01)

(58) Field of Classification Search

CPC ..... A42B 3/122; A42B 3/0453; A42B 3/142; A42B 3/20; A42B 3/283

See application file for complete search history.

(56) References Cited

U.S. PATENT DOCUMENTS

| | | | | |
|---|---|---|---|---|
| 3,765,412 | A | 10/1973 | Ommaya | |
| 5,091,992 | A | 3/1992 | Pusic | |
| 5,133,084 | A | 7/1992 | Martin | |
| 5,313,670 | A | 5/1994 | Archer, III | |
| 5,402,535 | A | 4/1995 | Green | |
| 7,150,048 | B2 | 12/2006 | Buckman | |
| 7,370,370 | B2 | 5/2008 | Colombo | |
| 8,402,568 | B2 | 3/2013 | Alstin et al. | |
| 2017/0196293 | A1* | 7/2017 | Podboy ..... | A42B 3/122 |

* cited by examiner

*Primary Examiner* — Shaun R Hurley

*Assistant Examiner* — Andrew W Sutton

(74) *Attorney, Agent, or Firm* — Fredrikson & Byron, P.A.

(57) ABSTRACT

Embodiments include an inflatable blast-induced brain injury prevention device for living beings such as soldiers. The device may include one or more inflatable chambers that cooperate to form a substantially toroidal cervical collar configured to surround the soldier's neck. An inflator unit, activated by an initiator may be coupled to the one or more inflatable chambers to inflate the one or more inflatable chambers. An electronic control unit (ECU) in electrical communication with the initiator and in electrical communication with at least one sensor may be configured to measure atmospheric air pressure. The ECU may be programmed to activate the initiator when the air pressure measured by the sensor exceeds a threshold air pressure.

28 Claims, 14 Drawing Sheets

INFLATABLE BLAST-INDUCED BRAIN INJURY PREVENTION DEVICE

RELATED APPLICATIONS

The present application claims priority to U.S. Provisional Application 62/091,856, filed Dec. 15, 2014, the entire contents of which is incorporated herein by reference.

BACKGROUND

Blast related traumatic brain injury (bTBI) is a frequent outcome of exposure to explosive device detonation. During Operation Iraqi Freedom and Operation Enduring Freedom in Afghanistan, improvised explosive devices (IED), vehicle borne IED and improvised rocket assisted mortars have become the preferred weapons used against American troops. Over 300,000 US military personnel are documented to have suffered bTBI due to IED blast exposures over the last 10 years of war. According to the Defense and Veterans Brain Injury Center, more than 50% of injuries sustained during the conflicts in Iraq and Afghanistan are the result of explosives including bombs, grenades, land mines, mortar/artillery shells and IEDs Since 2006, blasts have been the most common cause of injury among American solders treated at Walter Reed Army Medical Center.

In addition to the destroyed lives and families, researchers estimate that the cost of treating a solder with severe bTBI is between $600,000 and $5,000,000 over his or her lifetime.

TBI (traumatic brain injury) from explosive blasts are poorly understood due to the near impossibility of doing human research on the mechanisms of causation. While animal research has been done, the animal models have not been validated to correlate with human injuries. After the blast, the noninvasive methods of detecting focal and often subtle brain injuries in injured soldiers are not adequately reliable or sensitive. Finally, further confusion is added because there are multiple causative mechanisms that each result in different brain injuries which all interact and add up to the total injury. Virtually all of the research to date has focused on defining the injuries that add up to the TBI, defining the mechanisms of injury and possible treatments after the injury. The instant inventors are not aware of any viable suggestions for preventing or reducing TBI due to explosive blasts.

It is currently thought that there are three basic mechanisms of TBI from explosive blasts:

Primary blast injuries are caused by blast overpressure waves or shock waves. High-order explosives produce a supersonic shock wave of high-pressure air lasting a few milliseconds. The excess barometric pressure can reach up to 100 pounds per square inch (PSI) traveling at a velocity of 1500 mph (an overpressure of 60-80 PSI is considered potentially lethal). To put this in perspective, blasts and blast pressure waves are obviously a regular part of combat in one degree or another. For example, a large bore rifle or pistol produces sound pressure levels of 170-175 dB, which is approximately equal to 1 PSI of air pressure. A howitzer crew may be subjected to blast pressures of 5 PSI each time they shoot their gun.

The overpressure waves cause the most damage to air-filled organs such as the ear, lung and gastrointestinal tract. Since the brain is protected by a non-compressible, rigid skull and does not have compressible air within the skull, most investigators currently believe that the blast overpressure waves are not significant direct contributors to blast induced TBI.

However, there is good evidence that blast overpressure waves compressing the chest indirectly contribute to TBI. A number of animal studies have shown that the rapid and massive compression of the chest forces high-pressure blood into the non-compliant cranial vault. The result is a momentarily huge increase in the intracranial pressure, known as hydrostatic or hydraulic shock. Post mortem animal studies of this phenomenon show wide-spread leaking from blood vessels within the brain, a phenomenon that is well known to cause brain damage much like multiple small hemorrhagic strokes.

Secondary blast injuries are caused by fragmentation and other objects propelled by the explosion causing penetrating injuries to the head.

Tertiary blast injuries are caused by the high velocity "blast wind" that follows the shock wave. The blast wind first expands out from the explosion at up to 330 mph and then may reverse direction when the air around the explosion gets sucked back to fill the vacuum created by the blast or if the blast wave is reflected off of a solid object like a wall. These high velocity blast winds cause the head and extremities to move violently first in one direction and then in the opposite direction. This movement is virtually identical to the violent movement seen in whiplash injuries from high-speed motor vehicle crashes. The TBI from this violent angular acceleration/deceleration of the head whipping back and forth faster than the body (which has a higher mass and is, therefore, harder to accelerate), results in the coup/countercoup brain injuries seen in both humans and animal models of blast injuries, as well as neck injuries.

Animal research shows that mouse brains are significantly protected when the head of the animal is stabilized so that it cannot be whipped back and forth by the blast wind.

Tertiary blast injuries may also occur when the blast winds cause the soldier to be thrown onto a solid object such as a wall or the ground. A severe impact to the head of the soldier can obviously contribute to the total bTBI.

It is apparent that there are several tertiary mechanisms of blast injury, each of which contribute in varying degrees to the total bTBI caused by the explosion. bTBI is a complex brain injury caused by multifactorial assaults emanating from the blast. Each of these multifactorial assaults are affected by multiple factors such as: size of the explosion, distance from the explosion, orientation of the person to the explosion, use of body armor and helmets, proximity to reflecting objects such as walls or vehicles and the body part that hits the ground or wall first, to name a few. The resulting bTBI is the summation of all of these focal and unpredictable injuries.

In the case where the blast itself is not preventable or avoidable, protection measures against the blast may be useful. Current research suggests that the blast overpressure wave itself may not be a major contributor to the bTBI (primary blast injury).

Finally, the secondary blast injuries caused by penetrating fragmentation injuries may not be preventable or avoidable and are beyond the scope of this patent. Therefore, if preventive measures are going to be useful, they must be focused on preventing the tertiary blast injuries.

Critical to understanding this invention is understanding that there is an obligatory time delay between the nearly instantaneous arrival of the blast wave and the arrival of the slower moving blast wind, which is the cause of the tertiary blast injuries. There is an additional time delay between the arrival of the blast wind and the resulting angular acceleration and movement of the head relative to the heavier, slower accelerating body. Then there is an additional time delay between the acceleration of the body (and head) through the air and the rapid deceleration of that head and body as it impacts the ground or other hard object. Finally, the hydrostatic shock wave to the brain is also delayed because the chest must first be compressed, forcing the blood out of the chest under high pressure into the arteries and veins of the neck and then into the skull—all of which takes time.

We will assume a worst case, but still possibly survivable scenario of an explosion occurring 10 ft. from the soldier and the resulting blast wind velocity of 300 mph. In this case there is a 0.023 second or 23 millisecond (msec.) time delay between the arrival of the blast wave and the arrival of the blast wind. It is also reasonable to assume that the acceleration resulting in movement of the head relative to the body and the movement of the body relative to the ground will add an additional 20-100 msec. in delay. Therefore, in the worst case scenario, there is a minimum of a 43 msec. time delay between the arrival of the blast wave and the onset of the tertiary blast injuries. Obviously, the time delay is greater if the explosion is further from the soldier or if the injury is from being thrown to the ground. It is reasonable to estimate that the tertiary blast injuries occur between 43 msec. and 200 msec. after the arrival of the blast wave.

It is logical to assume that if any of the contributing mechanisms of tertiary blast injury can be reduced or eliminated, the resulting focal injuries should be reduced and the resulting sum total bTBI should also be reduced. The 43 msec. to 200 msec. time delay gives a brief opportunity to intervene and possibly mitigate the damaging effects of some or all of the tertiary mechanisms of injury due to the blast wind that lead to bTBI following an explosion. There is also an opportunity to intervene and possibly mitigate the damaging effects of some or all of the indirect primary mechanisms of bTBI injury due to the blast overpressure wave producing hydraulic shock by occluding the major blood vessels between the chest and the brain, preventing the high-pressure blood from reaching the brain.

A wide variety of inflatable protective devices have been disclosed over many years. These have been designed to protect the head, neck and/or body of persons who are falling or crashing (bicycles, motorcycles, automobiles, racecars and pilots). Some examples include: Alstin discloses a helmet for a bicycle rider that inflates during a crash in U.S. Pat. No. 8,402,568. Ommaya in U.S. Pat. No. 3,765,412; Martin in U.S. Pat. No. 5,133,084; Green in U.S. Pat. No. 5,402,535; Archer in U.S. Pat. No. 5,313,670 all disclose inflatable neck collars for protecting automobile drivers, racecar drivers, motorcyclists and pilots from neck injuries during crashes. Colombo in U.S. Pat. No. 7,370,370 and Pusic in U.S. Pat. No. 5,091,992 disclose inflatable suits that inflate during a motorcycle crash. Buchman in U.S. Pat. No. 7,150,048 discloses a variety of inflatable suits that inflate during a fall for protection of the elderly. All of these prior art devices are variations of airbag technologies that have been developed for automotive safety over the past 50 years.

All of the cited prior art as well as the automobile airbag technologies rely on the detection of rapid deceleration, acceleration, angular acceleration or changes in attitude to determine if a crash or fall is in progress and then to trigger the safety device. Accelerometers and gyroscopes are used to detect the acceleration/deceleration and then sophisticated algorithms analyze the input data to determine whether or not the detected acceleration is a crash or fall that requires deployment of the airbag.

SUMMARY OF THE INVENTION

We assume that following an explosion, the blast wave itself and penetrating injuries due to shrapnel cannot be avoided. Therefore, the primary and secondary blast injuries are unavoidable. The focus of the blast injury protection device of the instant invention is to mitigate or eliminate the remaining known mechanisms of injury leading to bTBI caused by the blast—the tertiary blast injuries and the hydraulic shock from the blast overpressure wave. It is our critical observation that there is a minimum of a 40 millisecond (0.04 second) delay between the arrival of the high-pressure blast wave and:

1. the arrival of the blast wind and the blast wind causing angular acceleration of the head relative to the heavier body followed by deceleration and reversing of the movement back into the vacuum caused by the explosion.
2. the compression of the chest resulting in an increased intrathoracic pressure that propels high pressure blood through the carotid arteries and into the brain cavity of the skull.
3. the arrival of the blast wind and the blast wind throwing the soldier and impacting their head against a hard object.

It is apparent that there is at least a 40 msec. delay window during which an inflatable protective device can be inflated into its functional configuration.

This invention is an inflatable blast-induced brain injury prevention device for a soldier's head and neck that automatically inflates in response to the detection of a blast wave overpressure in excess of a predetermined threshold. This blast-induced brain injury protection device detects the blast wave overpressure and, in some cases, preferably inflates in less than 40 msec. In some embodiments, the inflatable blast-induced brain injury protection device may:

1. stabilize the neck and head so that the head cannot experience angular acceleration and deceleration movements relative to the body.
2. compress the carotid arteries and jugular veins preventing the flow of high pressure blood from the chest to the brain.
3. protect the face and head from impact with the ground or a wall.
4. protect the face and head from heat and flying debris.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

Figure 1:
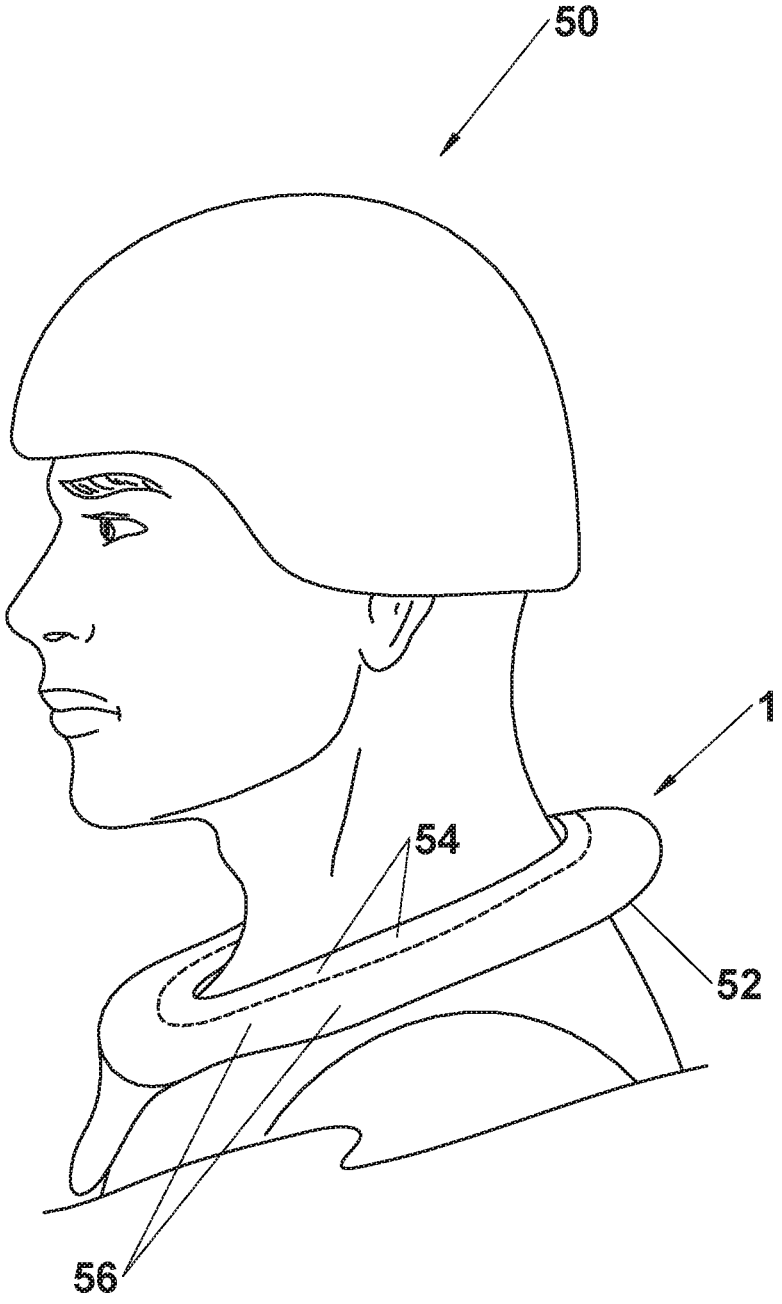
FIG. 1 depicts a side view of an exemplary embodiment of the injury prevention device in an un-inflated state, as worn by a solider.
Figure 2:
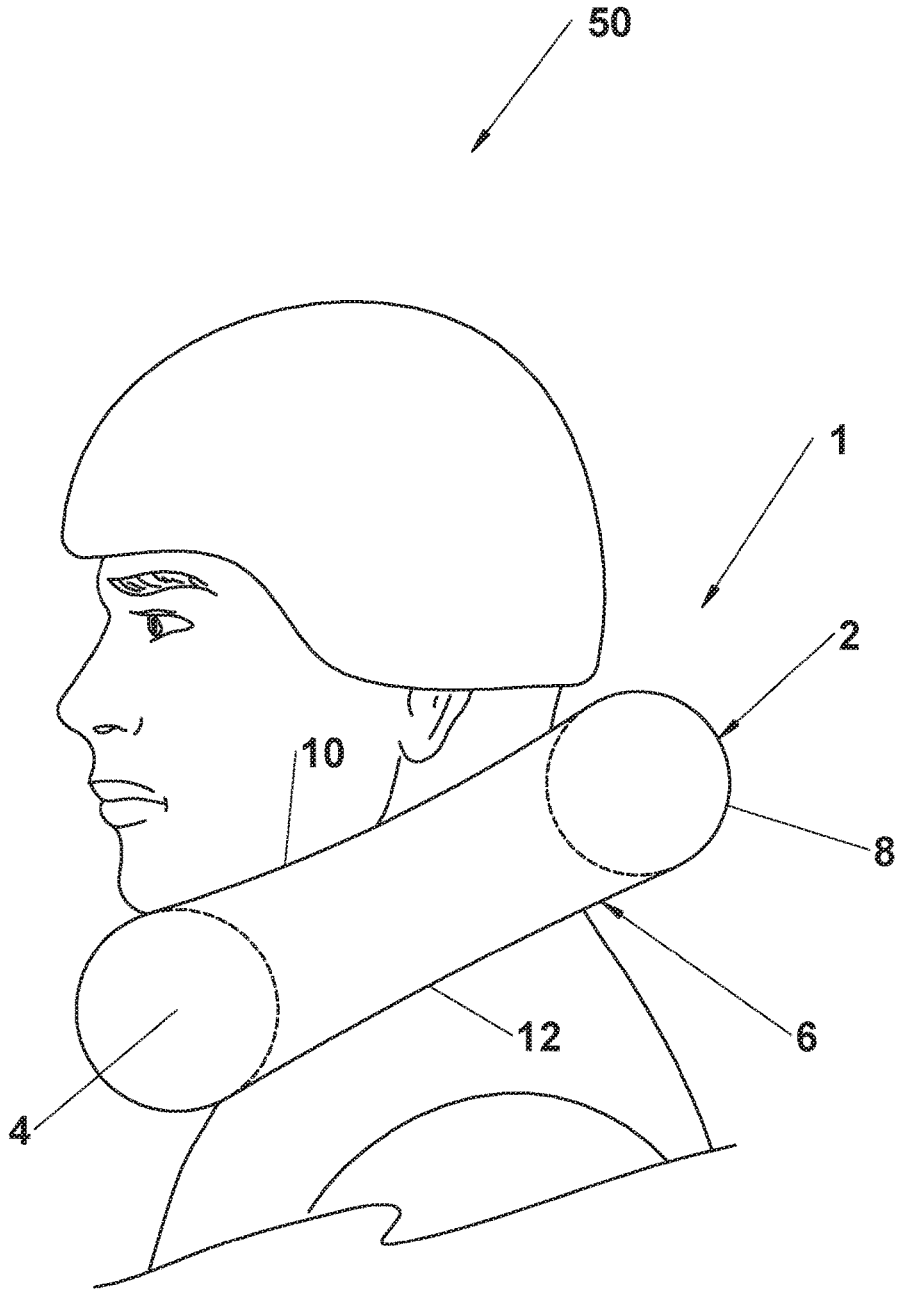
FIG. 2 depicts a side view of an exemplary embodiment of a cervical collar of the injury prevention device of FIG. 1 in an inflated state, as worn by a solider.
Figure 3:
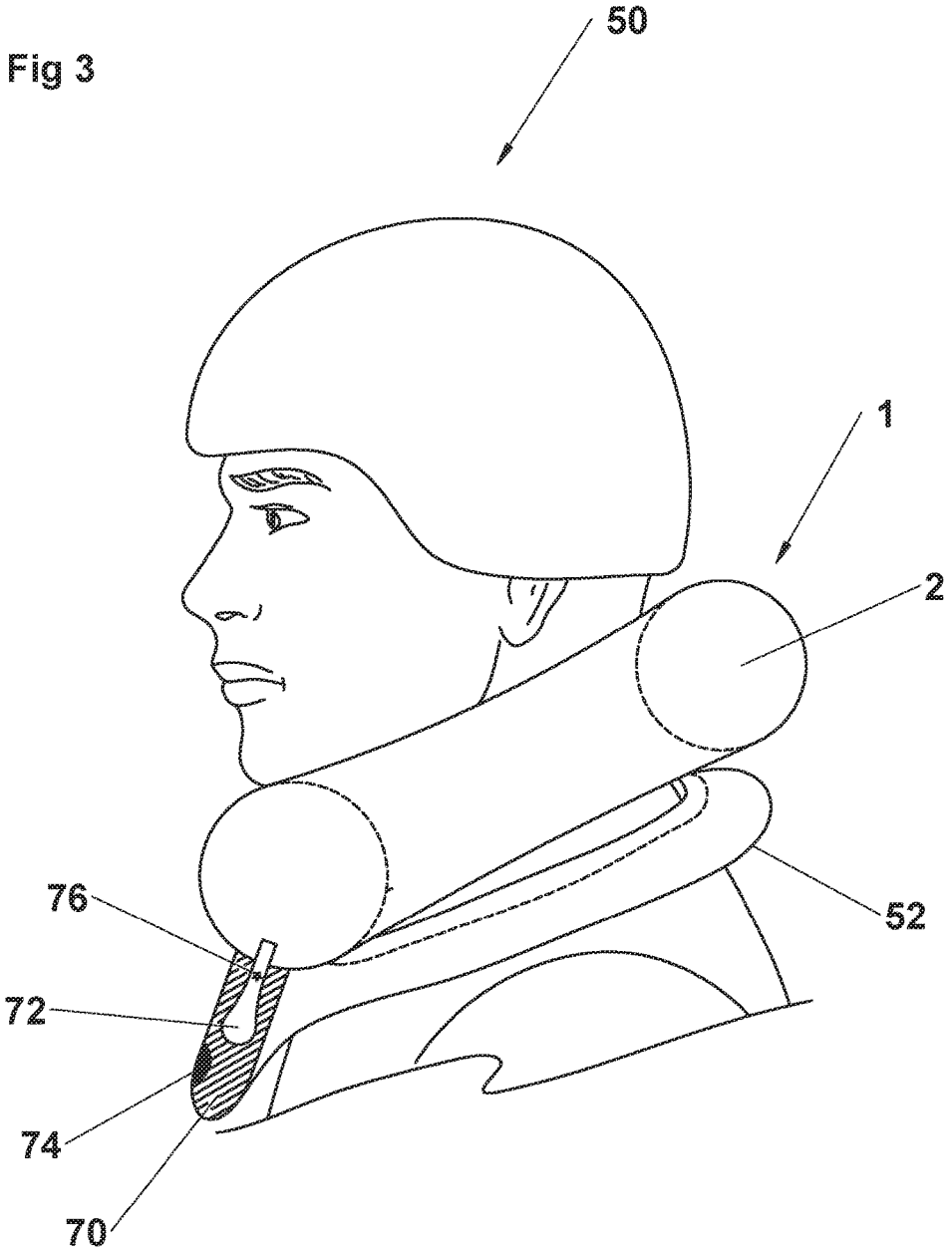
FIG. 3 depicts a side view of an exemplary embodiment of the injury prevention device of FIG. 1 in an inflated state, as worn by a soldier.

FIGS. 1-4 depict an exemplary embodiment of an inflatable blast-induced brain injury prevention device 1, including one or more inflatable air chambers 4, such as an inflatable cervical collar 2 that is positioned to surround at least a portion of the neck of the soldier 50. When the un-inflated base collar 52 is being worn, it may rest on the soldier's shoulders and loosely surround at least a portion of the neck. The un-inflated base collar 52 may also completely surround the neck. When inflated as shown in FIG. 2, the inflatable cervical collar 2 may assume a substantially toroidal shape and may look much like an inflated inner tube of a wheelbarrow tire at least partially surrounding the soldier's neck. The inflatable cervical collar 2 comprises one or more inflatable air chambers 4 in fluid communication with each other that cooperate to form a substantially toroidal collar 2 that at least partially surrounds the soldier's 50 neck when inflated. The inflatable cervical collar 2, may be a substantially toroidal cervical collar 2 that includes an inside side 6 facing the neck of the soldier, an outside side 8 facing away from the neck, an upper side 10 and a lower side 12. The inside circumference of the un-inflated base collar 52 is preferably large enough to allow the un-inflated base collar 52 to fit over the soldier's head in order to be placed around their neck.

In some embodiments, when inflated, the tubular substantially toroidal-shaped inflatable cervical collar 2 snuggly surrounds all or at least a portion of the soldier's neck, resting on the shoulders laterally and inflating into the space under the jaw anteriorly and under the occiput posteriorly. The toroidal-shaped inflatable cervical collar 2 includes a front or anterior portion which is positioned in front of the user's neck and a back or posterior portion that is positioned behind the user's neck. The purpose of the inflatable cervical collar 2 is to stabilize the neck and head so that the blast wind and vacuum that follows do not cause angular acceleration of the head relative to the body with sudden deceleration or whiplash. Whiplash movements of the head are well known to result in coup/countercoup contusions or bruises to the opposite sides of the brain as it bounces off of the inside of the skull. Stabilizing the neck does not prevent overall movement of the head, but it can prevent the angular acceleration that is caused by the head accelerating and decelerating faster than the body that has more mass and slower acceleration. Therefore, the inflatable cervical collar 2 may prevent or reduce the movement of the head relative to the body—the whiplash effect caused by the blast wind.

Figure 4:
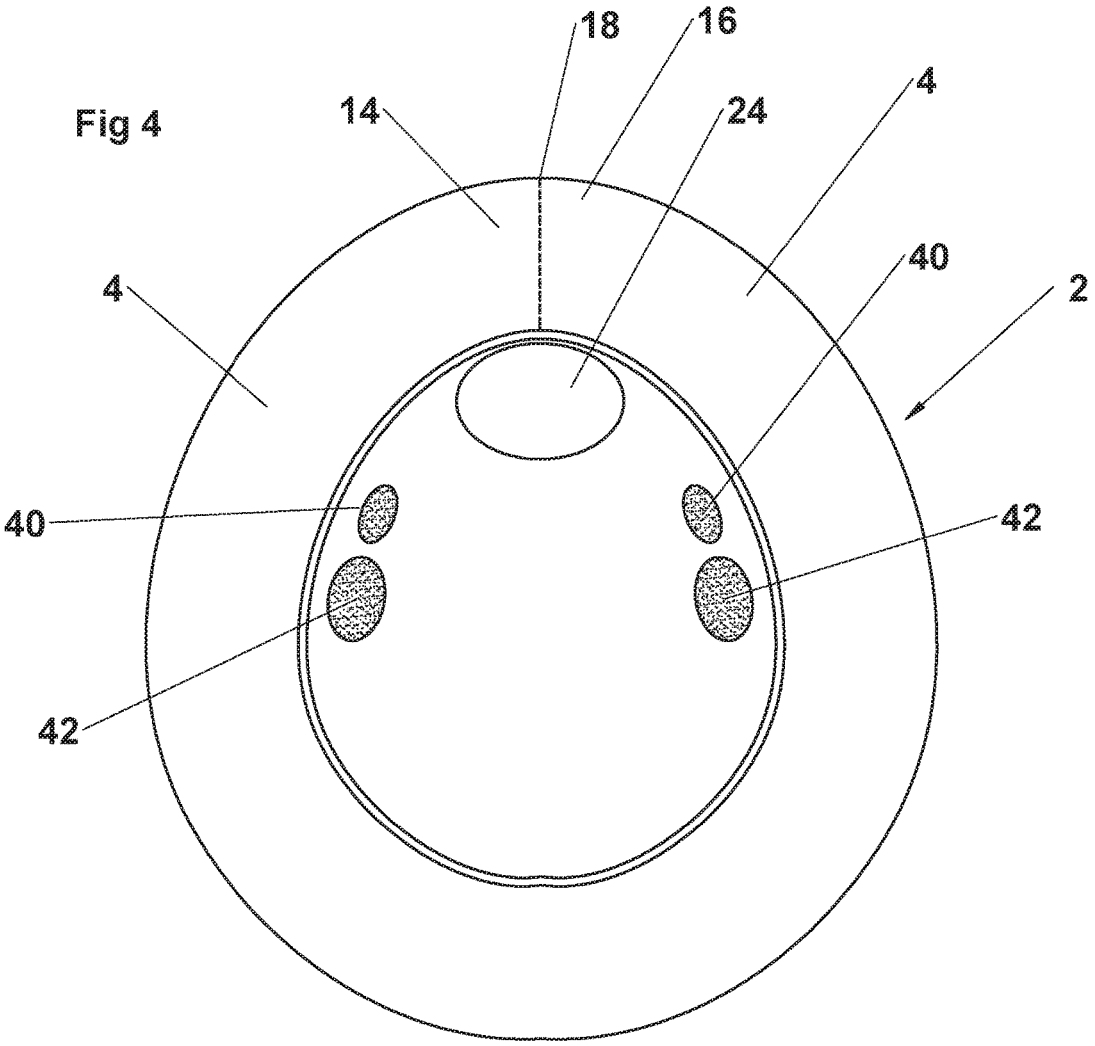
FIG. 4 depicts a top view of an embodiment of an inflated cervical collar in relation to anatomy of a soldier's neck.
Figure 5:
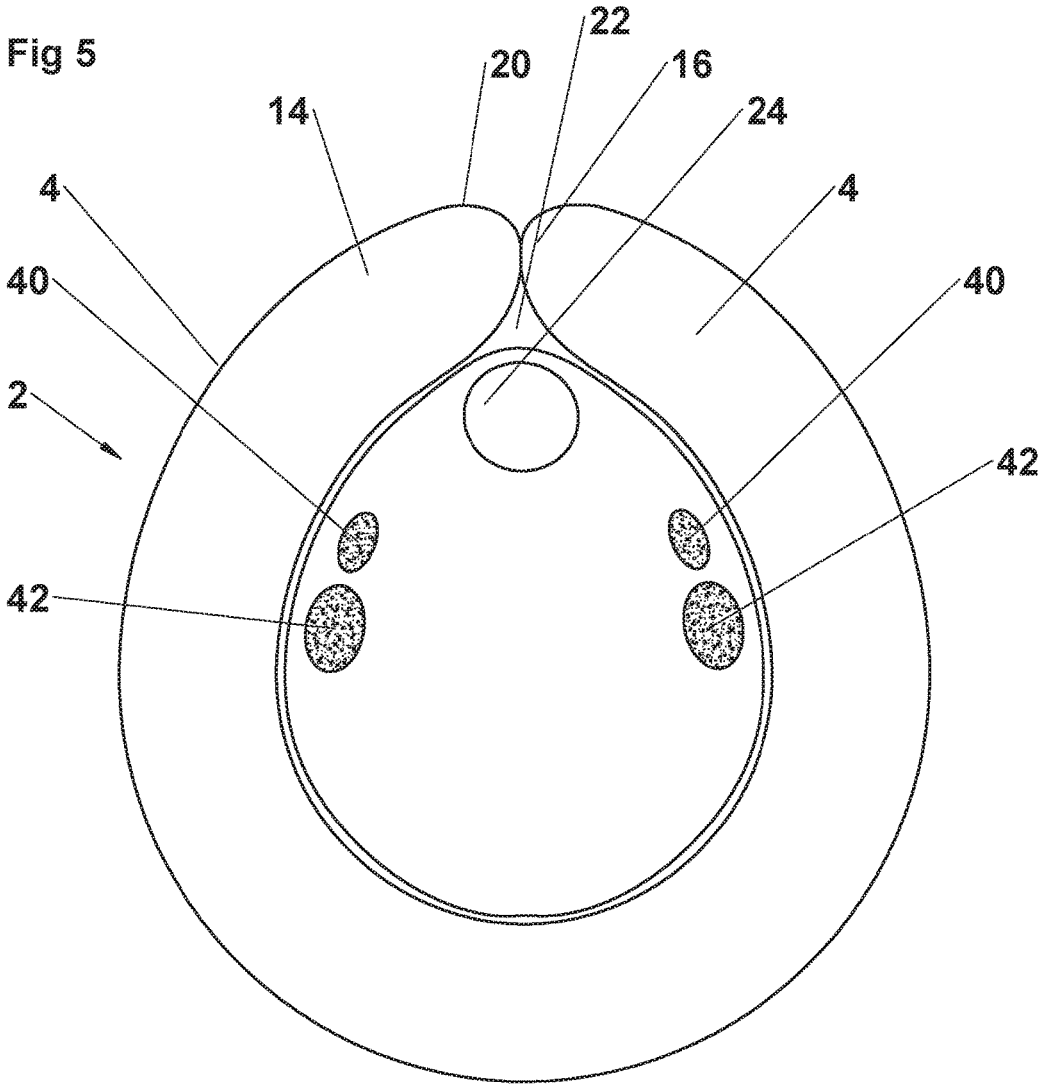
FIG. 5 depicts a top view of another embodiment of an inflated cervical collar in relation to anatomy of a soldier's neck.
Figure 6:
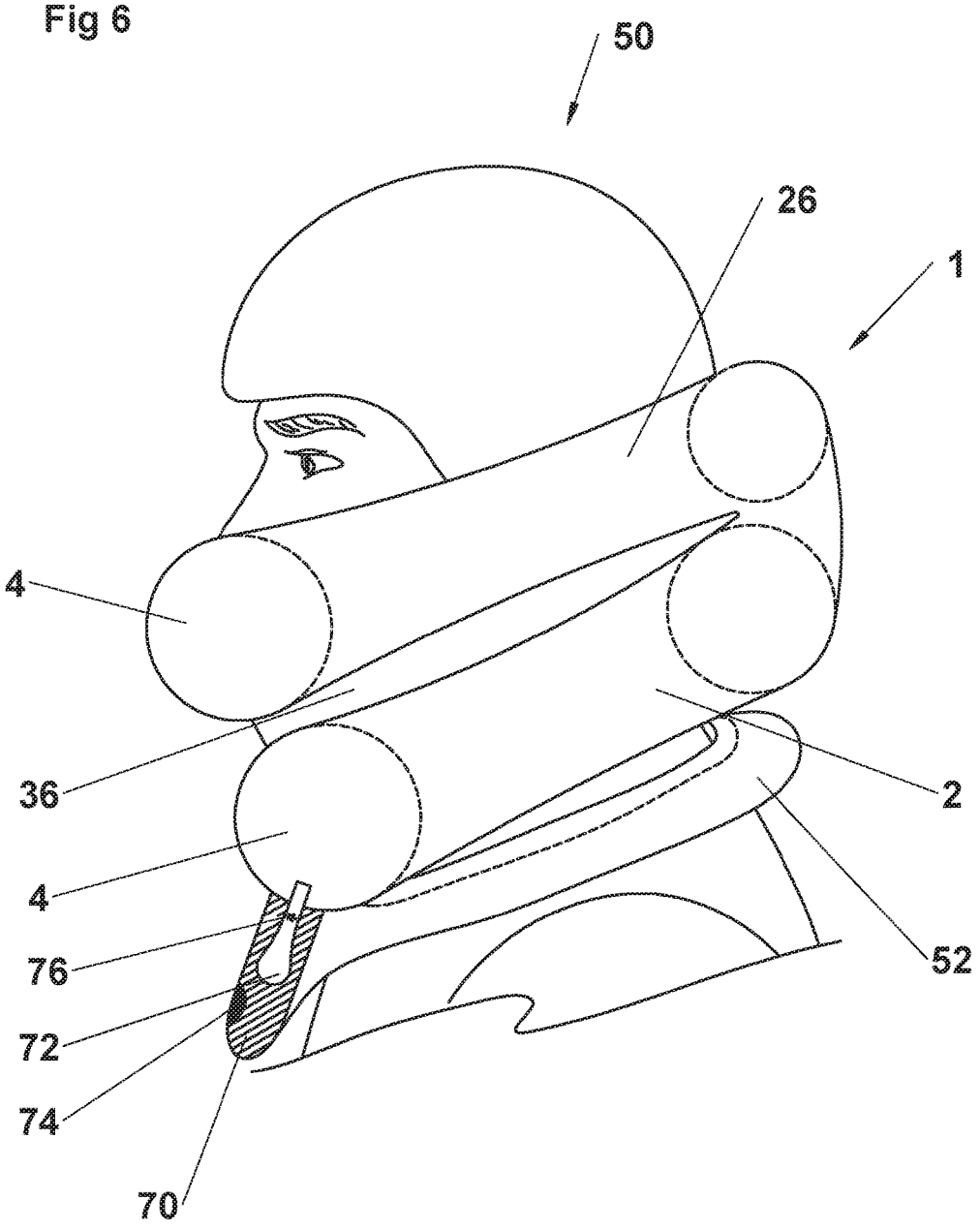
FIG. 6 depicts a side view of a second embodiment of the injury prevention device of FIG. 1 in an inflated state, as worn by a soldier.

As shown in FIGS. 5-6, in some embodiments the inflated toroidal-shaped inflatable cervical collar 2 may be substantially tubular in all cross sections. The ends of the tubular air chambers 14, 16 (FIG. 5) may be bonded or sewn end-to-end 18 (FIG. 4). As shown in FIG. 5, in some embodiments the inflated toroidal-shaped inflatable cervical collar 2 may be substantially tubular in all cross sections except that it may be pleated in the front. Rather than the ends of the tubular air chambers 14, 16 being bonded or sewn together end-to-end 18, the end of the tubular air chambers 14, 16 are bonded or sewn together side-to-side 20 (FIG. 5). This configuration is not only advantageous for manufacturing expediency, but also it creates a "V" shaped space 22 at the front of the neck, minimizing the pressure applied directly to the larynx 24 (voice box) when inflated. Sudden pressure applied to the larynx 24 can fracture the fragile laryngeal cartilage and crush the windpipe.

In some embodiments, the inflatable toroidal-shaped cervical collar 2 may advantageously be a combination of round in cross section in some areas and oval in cross section in other areas. For example, the front of the inflatable cervical collar 2 adjacent to the trachea and larynx 24 of the soldier 50 may advantageously be vertically oval in cross section to minimize pressure applied inwardly toward the trachea and larynx 24. One or more partitions or cords may be built into the cervical collar 2 at that location and may limit the expansion of the collar 2 in the horizontal dimension. In some embodiments, the cross sectional diameter of the toroidal-shaped inflatable cervical collar 2 may vary from one location to the next in order to accommodate features of the head and helmet or to prevent obstruction and interference during inflation.

In some embodiments, the substantially toroidal inflatable cervical collar 2 is openable in at least one point in its circumference. In some embodiments it may be preferable that the openable point is at the back of the neck, but other locations are anticipated. The two opposing openable ends of the cervical collar 2 may include a means for connecting the two ends together. The two ends of the inflatable cervical collar 2 may be mechanically attached to each other by Velcro, snaps, ties or other suitable closure means. Alternately, the two ends of the inflatable cervical collar 2 may interlock with each other in order to optimally stabilize the inflated collar 2 where the collar 2 is openable.

In some embodiments, as shown in FIG. 6, the inflatable blast-induced brain injury protection device 1 includes a second inflatable face collar 26 that is located above and substantially parallel to the inflatable cervical collar 2 and surrounds the soldier's 50 face and sides and back of the head. The inflatable face collar 26 may be similar to the inflatable cervical collar 2 and comprises one or more inflatable air chambers 4 that cooperate to form a substantially toroidal tubular shape when inflated. The inner and outer circumferences of the inflated face collar 26 may be slightly larger than the corresponding circumference of the inflatable cervical collar 2. The larger diameter of the face collar 26 allows it to inflate around the solder's 50 head and helmet without encumbrance.

In some embodiments, as shown in FIG. 4, the inflated toroidal-shaped face collar 26 is substantially tubular in all cross sections. In some embodiments, as shown in FIG. 5, the inflated ring-shaped face collar 26 may be substantially tubular in all cross sections except that it may be pleated in the front. Rather than the ends of the tubular air chambers 14, 16 being bonded or sewn together end-to-end 18, the end of the tubular air chambers 14, 16 may be bonded or sewn together side-to-side 20. This configuration is not only advantageous for manufacturing expediency but also it creates a "V" shaped space 22 at the front of the face, minimizing the pressure applied directly to the nose. In some embodiments, the cross sectional diameter of the inflatable face collar 26 may vary from one location to the next in order to accommodate features of the head and helmet or to prevent obstruction and interference during inflation.

In some embodiments, the substantially tubular face collar 26 may be openable in at least one point in its circumference. In some embodiments, the openable point is preferably at the front or back of the neck but other locations are anticipated. The two opposing openable ends of the face collar 26 may include a means for connecting the two ends together. The two ends of the inflatable face collar 26 may be mechanically attached to each other by Velcro, snaps, ties or other suitable closure means. Alternately, the two ends of the inflatable face collar 26 may interlock with each other in order to optimally stabilize the inflated collar 2 where the collar 2 is openable. The construction method and materials for the face collar 26 are similar to the cervical collar 2.

In some embodiments, the inflatable blast-induced brain injury prevention device 1 includes a third inflatable collar 28 that is located above the inflatable face collar 26 and surrounds the soldier's head. The inflatable head collar 28 may be similar to the inflatable cervical collar 2 and face collar 26 and comprises one or more inflatable air chambers 4 that cooperate to form a substantially tubular toroidal shape when inflated. The inner and outer circumferences of the inflated head collar 28 may be slightly larger than the corresponding circumference of the cervical collar 2. The larger diameter of the face collar 26 allows it to inflate around the soldier's head and helmet without encumbrance.

In some embodiments, as shown in FIG. 4, the inflated toroidal-shaped head collar 28 is substantially tubular in all cross sections. In some embodiments as shown in FIG. 5, the inflated toroidal-shaped head collar 28 may be substantially tubular in all cross sections except that it is pleated (e.g., 20) in one or more locations. Rather than the ends of the tube being bonded or sewn together end-to-end 18, the end of the tubes are bonded or sewn together side-to-side 20. This configuration is advantageous for manufacturing expediency. In some embodiments, the cross sectional diameter of the inflatable head collar 28 may vary from one location to the next in order to accommodate features of the head and helmet or to prevent obstruction and interference during inflation.

In some embodiments, the substantially toroidal head collar 28 may be openable in at least one point in its circumference. In some embodiments the openable point is preferably at the back of the neck, but other locations are anticipated, including the front of the neck. The two opposing openable ends of the head collar 28 may include a means for connecting the two ends together. The two ends of the inflatable head collar 28 may be mechanically attached to each other by Velcro, snaps, ties or other suitable closure means. Alternately, the two ends of the inflatable head collar 28 may interlock with each other in order to optimally stabilize the inflated collar 2 where the collar 2 is openable. The construction method and materials for the head collar 28 may be similar to the cervical collar 2.

Figure 7:
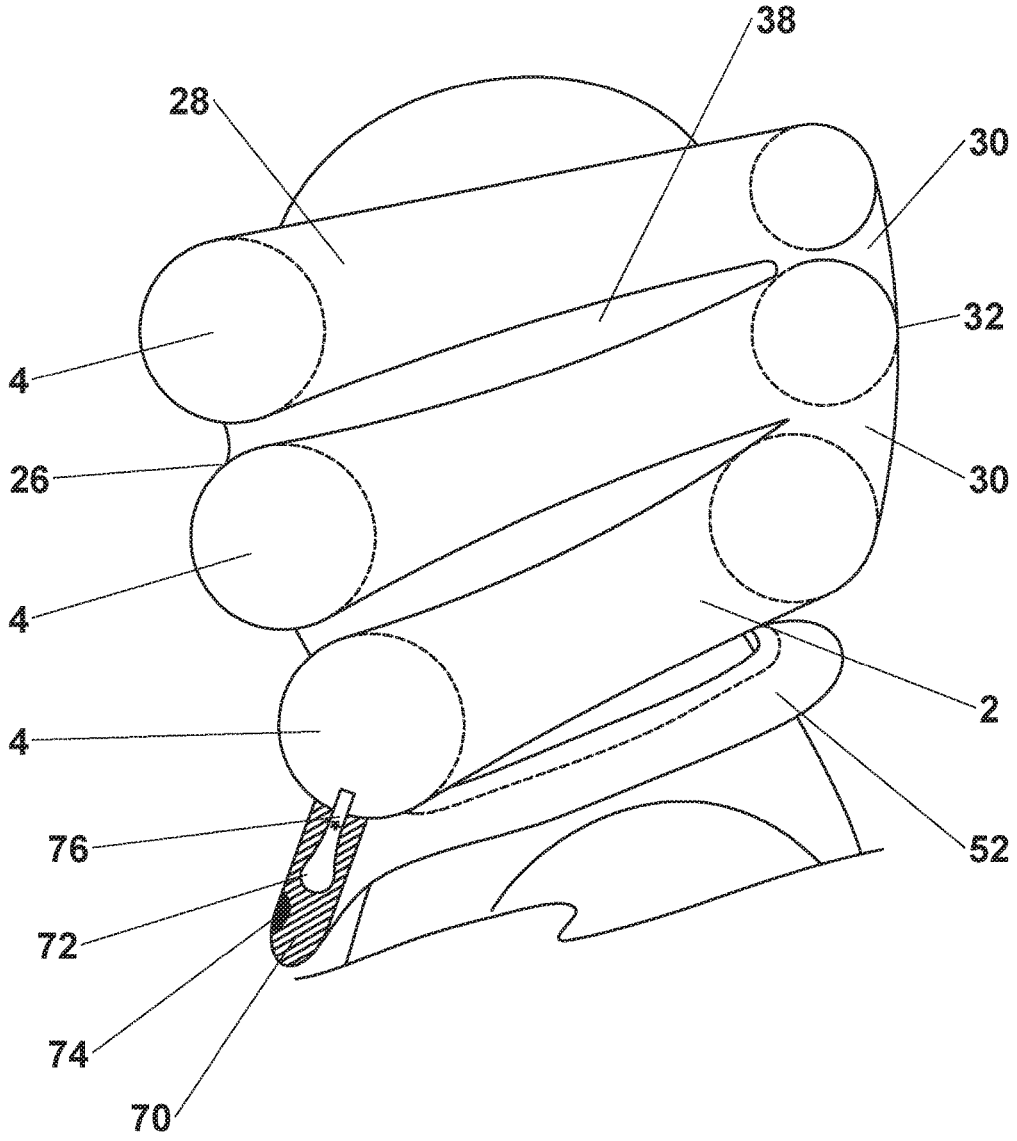
FIG. 7 depicts a side view of a third embodiment of the injury prevention device of FIG. 1 in an inflated state, as worn by a solider.
Figure 8:
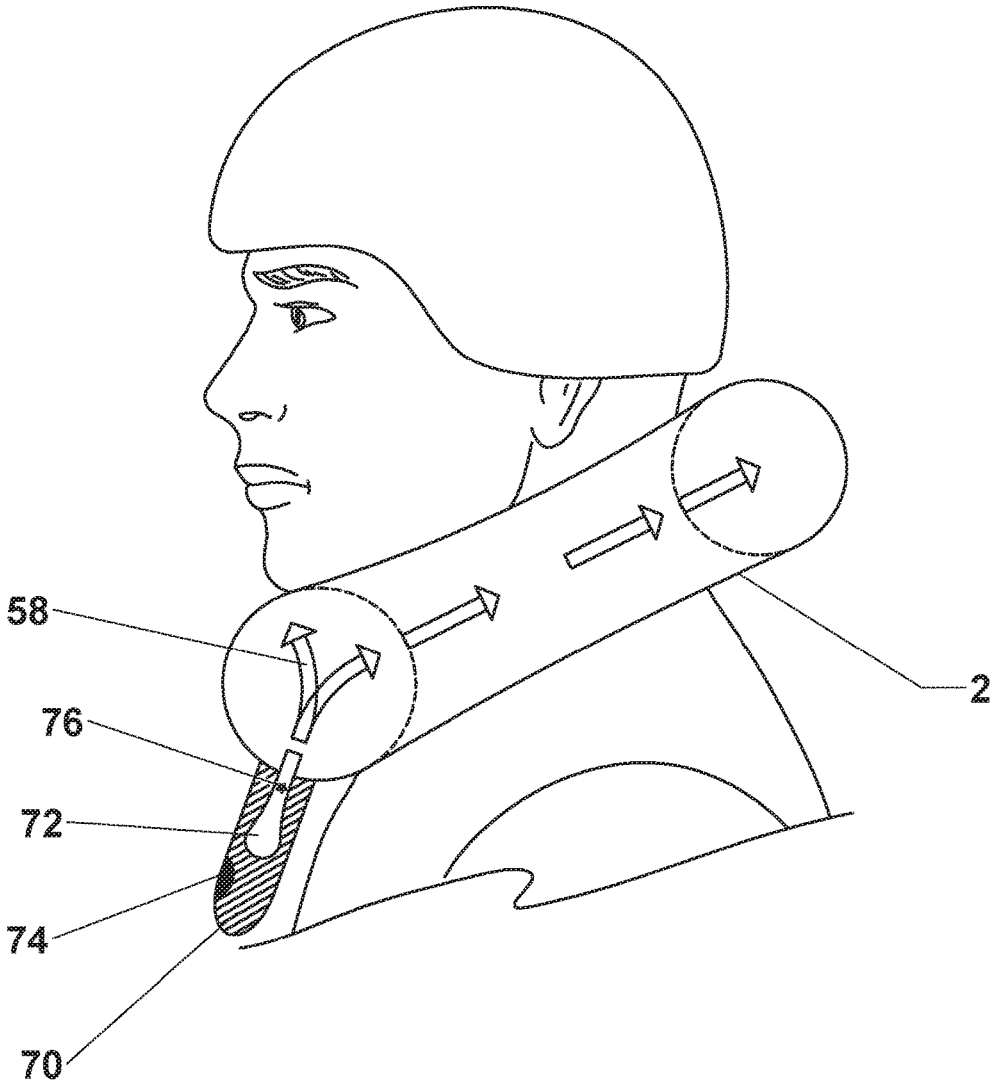
FIG. 8 depicts a side view of an embodiment of the gas flow of the injury prevention device of FIG. 2, as worn by a solider.
Figure 9:
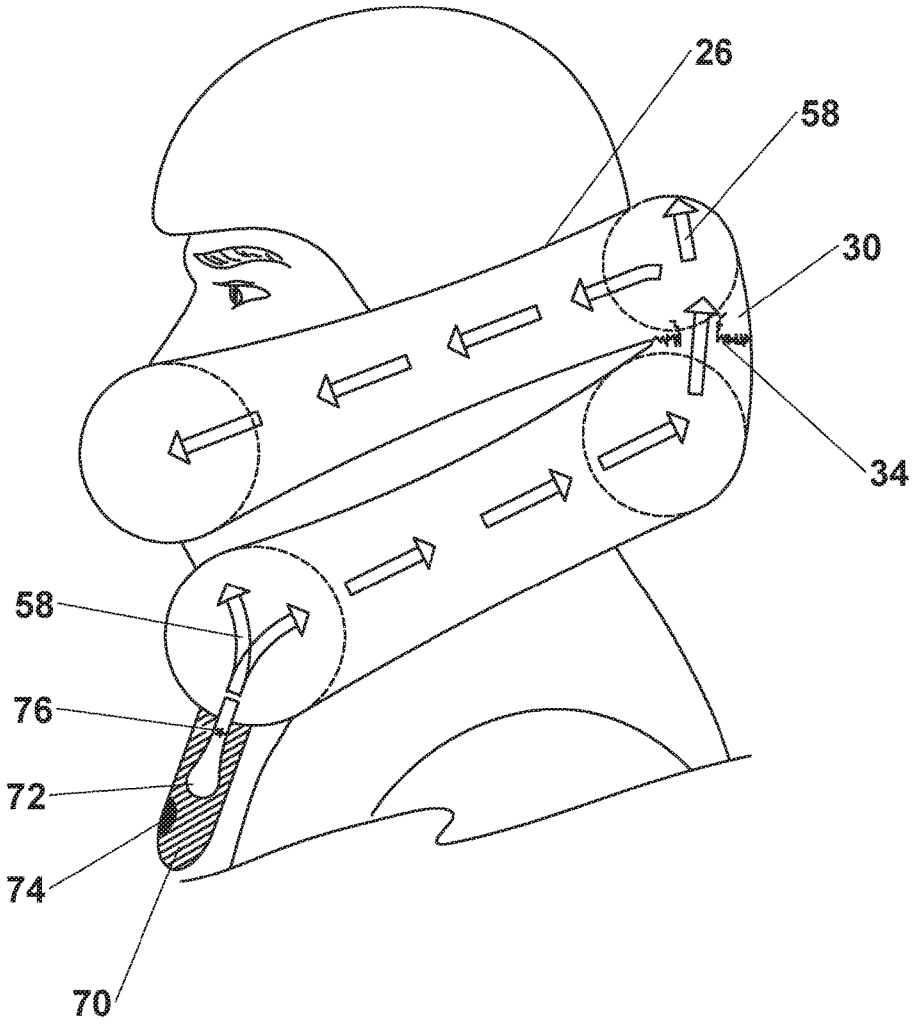
FIG. 9 depicts a side view of an embodiment of the gas flow of the injury prevention device of FIG. 6, as worn by a soldier.
Figure 10:
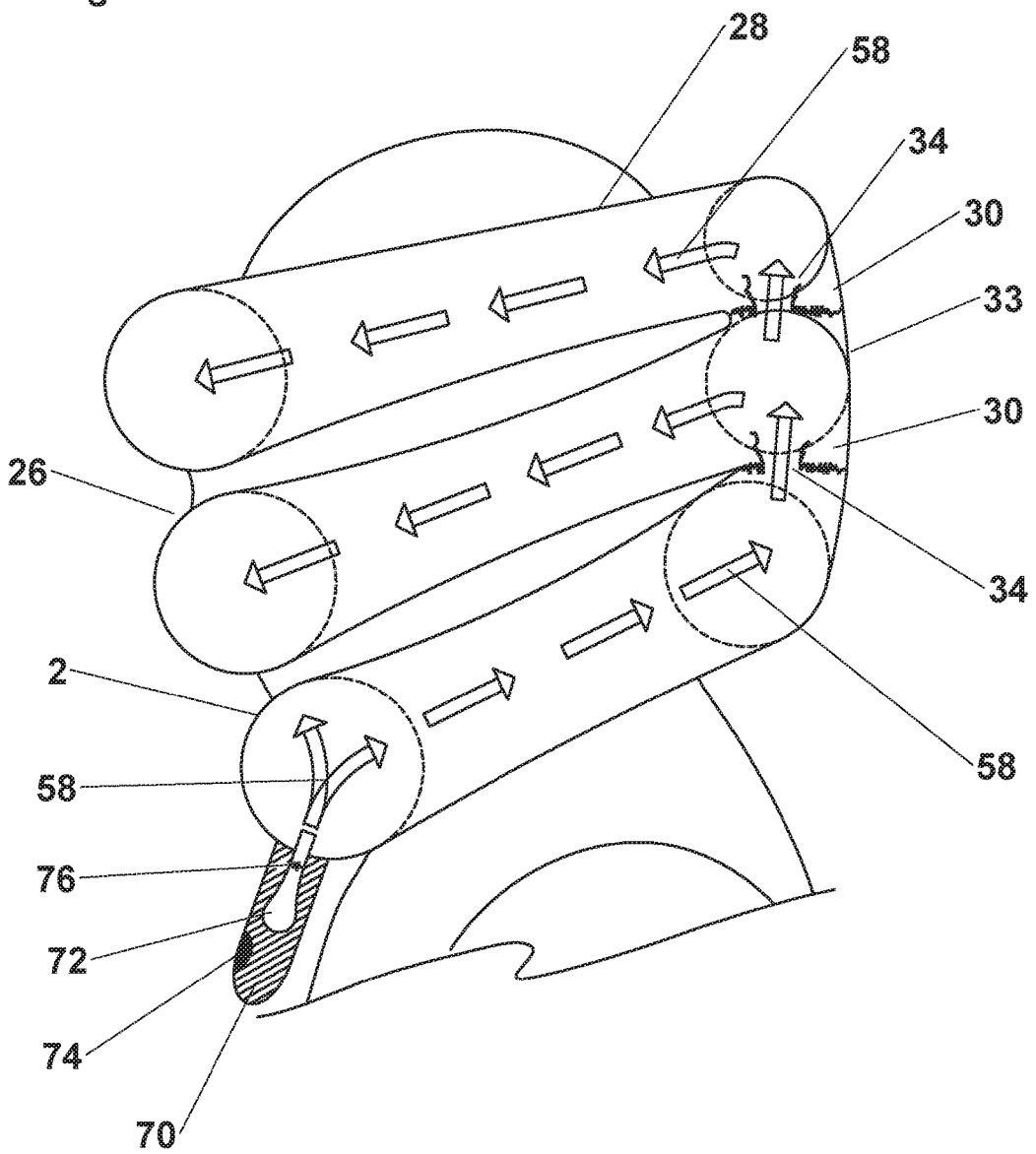
FIG. 10 depicts a side view of an embodiment of the gas flow of the injury prevention device of FIG. 7, as worn by a solider.

In some embodiments, as shown in FIG. 7, the inflatable face collar 26 and head collar 28 are in fluid communication with the inflatable cervical collar 2 at the rear of the device 1, behind the head. The location of the interconnecting air plenum 30 at the back of the head may have several advantages. First, as shown in FIGS. 8-10, by injecting the inflating gas 58 into the inflatable cervical collar 2, it forces the cervical collar 2 to inflate first, before the inflating gas vents through the interconnecting air plenum 30 into the face collar 26 and head collar 28. This assures that the neck is stabilized against whiplash first, before protecting the head from ground trauma. Of the tertiary blast injuries, whiplash occurs before ground impact, therefore, protecting against whiplash first may be advantageous. Second, the interconnection between the inflatable chambers creates an interconnecting air plenum 32 (e.g., a chamber 4) in the back that has a greater diameter than the collar 2 itself and, therefore, generates more force pushing backward from the head and neck. The result is that the inflatable cervical collar 2 is pulled tightly backward against the front of the neck, increasing the occlusive pressure applied to the carotid arteries 40. Third, the added volume in the interconnecting air plenum 32 (e.g., chamber 4) provides greater padding between the back of the head and the ground which may be advantageous when the soldier 50 is thrown backwards. In some embodiments, interconnecting fluid channels between the adjacent inflatable collars 2 may be located along the sides and/or in the front of the protective device 1.

In some embodiments, the interconnecting air plenum 30 or interconnecting channels may include internal baffles, orifices, tear stitches, tethers, breakaway features, diffusers or gas permeable fabrics, for example openable membrane 34 (FIGS. 9-10) that restrict, regulate, diffuse, filter, or otherwise control the flow of gases throughout the protective device 1. In some embodiments, the flow of gases between the inflatable collars 2 can be regulated by including an openable membrane 34 in the fluid channel that ruptures when an adequate pressure is reached in the preceding collar 2 being inflated. Openable membrane 34 may be coupled to outer layer 33, or any other suitable structure. Any suitable priority or hierarchy for simultaneous or sequential inflation of the collars 2 may be used. Other fluid flow control mechanisms are anticipated.

Regulating the flow of the inflating gas 58 allows sequential filling of the collars 2 that may be advantageous for several reasons. For example, filling the inflatable cervical collar 2 first may be advantageous in order to quickly stabilize the neck and head against the whiplash injury caused by the blast wind. Filling the face collar 26 before the head collar 28 prevents an inflated head collar 28 from impeding the upward expansion of the face collar 26. Filling the head collar 28 last not only allows unobstructed filling, but also has the most time to occur because of the time delay in the soldier 50 flying through the air to land on his or her head.

In some embodiments, as shown in FIG. 6, the substantially toroidal cervical collar 2 and substantially toroidal face collar 26 may include one or more un-inflated connections 36 between the two adjacent collars 2. Similarly as shown in FIG. 7, the substantially toroidal inflatable face collar 26 and substantially toroidal inflatable head collar 28 may include one or more un-inflated connections 38 between the two adjacent collars 2. The un-inflated connections 36, 38 may be made of the same material as the inflatable collars 2 or may be made of other materials. The un-inflated connections 36, 38 between the adjacent collars 2 may help to stabilize the adjacent collars 2 relative to each other during the violent blast wind and/or inflation. Additionally, the un-inflated connections 36, 38 block the open space between the adjacent collars 2, preventing heat and flying debris from hitting the soldier's 50 face.

In some embodiments, the inflatable collars 2 are made from materials that are well known in the automobile airbag arts. These include a variety of fabrics that are very strong and impervious to gases. Preferably these fabrics are woven, but could alternately be non-woven or knits. Suitable materials for the collar 2 fabric include but are not limited to: nylon, polyester (PET), polyimide, polyurethane, polytetrafluoroethylene (PTFE), Dacron, Kevlar, copolymers of the aforementioned, rip-stop nylon, cotton and the like. Impermeability, reduced permeability or controlled permeability to gases may be achieved by coating the fabric with a membranous material such as various rubber or plastic elastomers (silicone for example), or coating or laminating the fabric with other polymeric materials (such as polyurethane or PTFE for example).

Certain materials like nylon and coatings like silicone have relatively high melt points and, therefore, confer heat resistance or even heat shielding properties to the inflatable blast-induced brain injury prevention device 1. Similarly, materials such as Kevlar may provide protection from flying debris or even some shrapnel.

In some embodiments, the one or more inflatable air chambers 4 of the inflatable cervical collar 2 are formed by a sewing process. The various panels are shaped and sewn together to form the proper chamber 4 shape and dimension. Alternately, the fabric panels of the inflatable chambers may be bonded by adhesives or thermal bonding such as heat sealing, RF sealing or ultrasound sealing or combinations of these sealing and sewing technologies. In some embodiments the bond may be between materials that are coated onto the fabric rather than the fabric itself. For example, a thin urethane coating or lamination may be applied to a nylon fabric and the urethane coating can be RF sealed to the urethane coating of the adjacent panel. Other bonding means are anticipated.

In some embodiments, the cross sectional shape of the inflatable cervical collar 2, when inflated, may be substantially round, like an inflated inner tube of a wheelbarrow tire at least partially surrounding the soldier's 50 neck. In some embodiments the cross sectional shape of the inflated cervical collar 2 may be substantially oval and the longer dimension may be oriented vertically. The oval cross sectional shape may be created by a plurality of flexible fabric partitions or cords within the inflatable chambers that may be shorter than the diameter of the inflated tube and may be attached to the inner and outer sides of the ring-like cervical collar 2. The fabric partitions or cords may limit the expansion of the cervical collar 2 in the horizontal dimension, increasing the expansion in the vertical dimension and thus creating a substantially oval cross sectional shape. The fabric partitions may be sewn to the sidewalls of the collar 2. The cords may be anchored at their ends, such as by piercing the sidewalls. The cords may be made of string, thin rope, monofilament line or molded plastic or rubber spacers. In some embodiments the partitions and cords may not substantially impede the flow of gases throughout the collar 2. However, in other embodiments the partitions and cords may impede, augment or redirect the flow of gases throughout the collar 2 as desired.

In some embodiments the fabric partitions or cords may be designed to break away or to lengthen at particular points in the deployment of the device 1 to facilitate a change in the pressure within the device 1, and thus a change in pressure applied to the soldier's neck, at different points in the blast event.

Another method of facilitating changes in the pressure applied to the soldier's neck is to provide venting of inflation gas 58 from the device 1. Venting systems may include variable venting systems which control the rate at which the inflation gas 58 is expelled from the device 1. Venting systems may include, but are not limited to, vent holes and permeable fabric materials.

In some embodiments, as shown in FIGS. 4 and 5 of the inflatable cervical collar 2, it may advantageous to have full expansion in a horizontal dimension by creating a round cross sectional shape or even an oval shape (with partitions or cords) with the long dimension oriented horizontally. An example where this configuration may be advantageous may include the case where occlusion of the carotid arteries 40 and/or jugular veins 42 is desirable to prevent the hydraulic shock effect of high-pressure blood being forced from the chest into the cranium. The carotid arteries 40 and jugular veins 42 are relatively superficial and run along the antero-lateral (front-side) aspects of the neck, from the chest to the skull. In some embodiments, occlusion or partial occlusion of the carotid arteries 40 and/or the jugular veins 42 may be accomplished by allowing the inflatable cervical collar 2 adjacent the carotid arteries 40 and/or jugular veins 42 to inflate into a round cross sectional shape or horizontally oval cross sectional shape. The inward expansion selectively applies pressure to the antero-lateral neck, momentarily occluding blood flow through the arteries and veins. Since, in some embodiments, the inflatable chambers may deflate within 5 seconds, the occlusion of the carotid arteries 40 is only momentary and does not cause any damage to the brain due to lack of blood flow.

In some embodiments, the cross sectional diameter of the inflatable head collar 28 may vary from one location to the next in order to accommodate features of the head and helmet or to prevent obstruction and interference during inflation. In some embodiments, the cross sectional shape of the inflated cervical collar 2 is substantially oval with the longer dimension oriented vertically along the sides of the soldier 50's head. The increased height of the collar 2 along the sides of the head improves the stabilizing effect of the collar 2 preventing lateral movement of the head.

Figure 11:
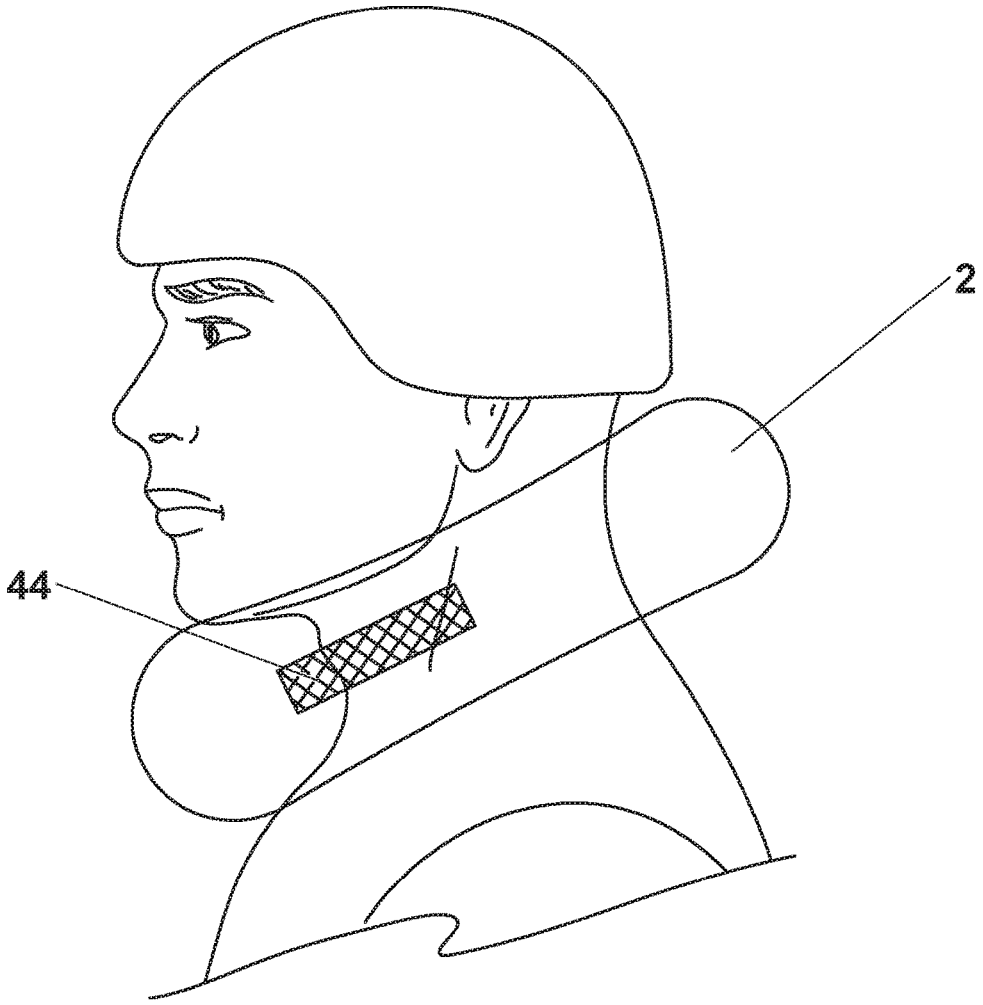
FIG. 11 depicts a side view of an embodiment of the cervical collar of FIG. 2 including occlusive members, as worn by a solider.
Figure 12:
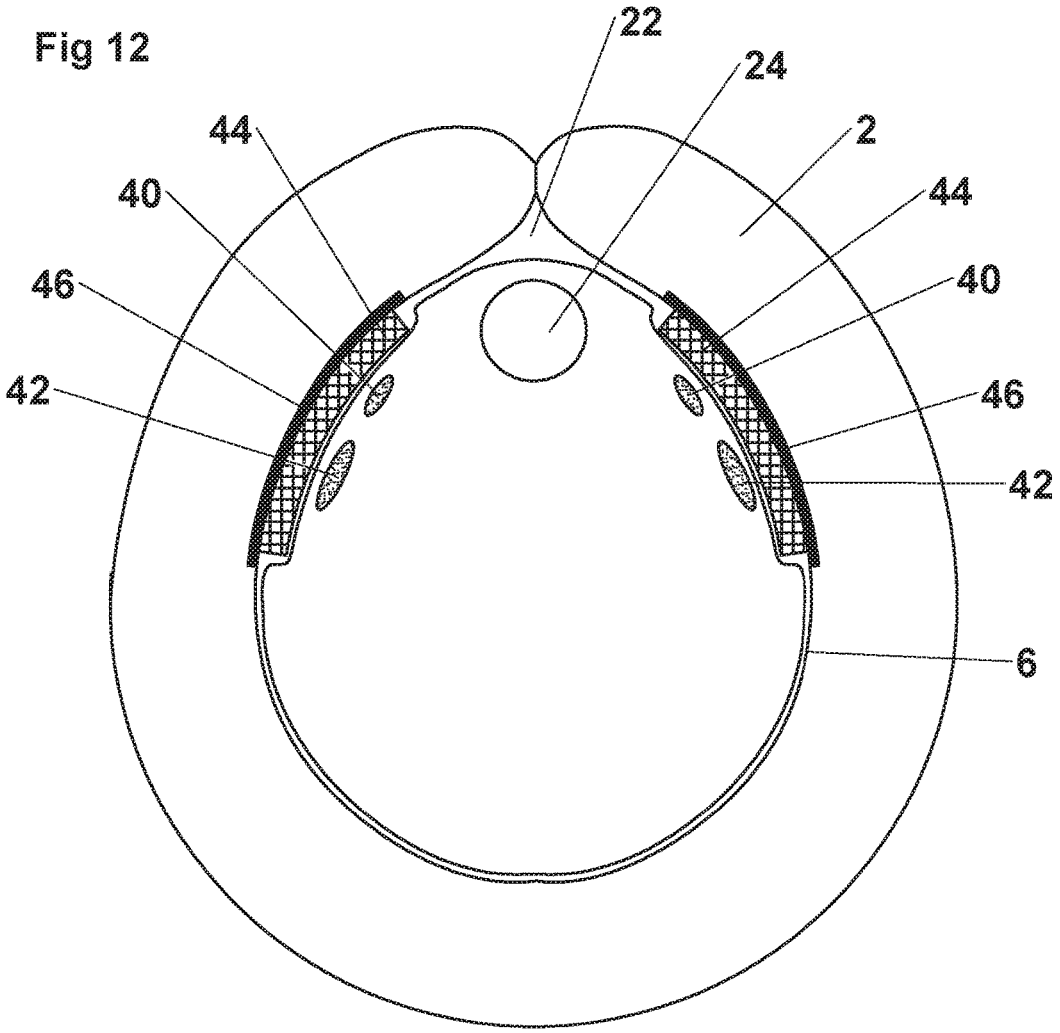
FIG. 12 depicts a top view of an embodiment of the cervical collar of FIG. 11 including occlusive members in relation to anatomy of the solider.
Figure 13:
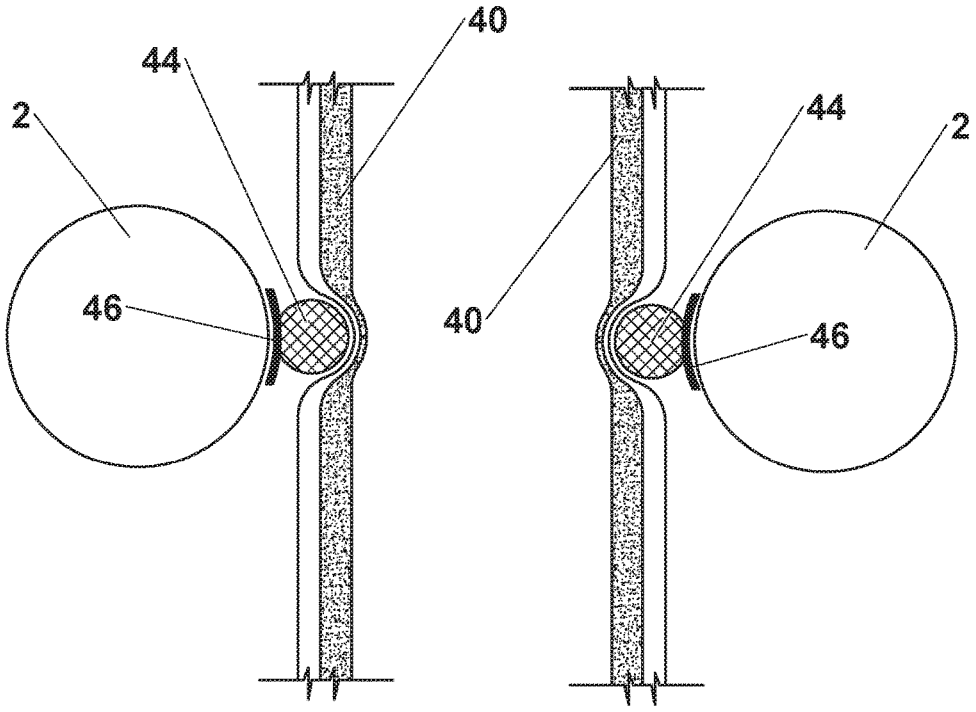
FIG. 13 depicts a vertical cross section through the neck of the soldier and cervical collar of the embodiment of FIGS. 11 and 12.

In some embodiments, as shown in FIGS. 11-13, occlusive members 44 may be added in areas where pressure can advantageously be applied to the neck. These occlusive members 44 are preferably attached to the surface of the inflatable cervical collar 2 and look like elongate ridges that protrude from the inner side 6 of the inflatable cervical collar 2. The elongate ridge-like occlusive members 44 may be located proximate the antero-lateral neck and, therefore, can selectively apply a more forceful occlusive pressure to the carotid arteries 40 and jugular veins 42 than can be applied by a round inflated cross sectional shape.

The occlusive members 44 may be between 1 and 3 inches long and between 0.25 and 0.75 inches in diameter. The occlusive members 44 may look very much like a piece of flexible pencil or a finger attached to the inside wall of a chamber 4 of the inflatable cervical collar 2 and oriented substantially parallel to the inner circumference of the inflatable cervical collar 2. The functioning of these occlusive members 44 may be configured to provide occlusive force to the body, like a finger or hand pressing against the side of the neck in order to occlude blood flow through the carotid artery 40.

The occlusive members 44 may be made of molded rubber, plastic, foam or any combination thereof. In some embodiments, the occlusive members 44 also include a flexible, thin, planar attachment base 46 that may be made of the same molded materials as the occlusive members 44. The attachment base 46 may not only allow a more robust attachment to the surface of the inflatable cervical collar 2, but may also allow a greater surface area of the inflatable cervical collar 2 to contribute to the occlusive pressure applied to the neck, thus potentially increasing the effective occlusive pressure.

Figure 14:
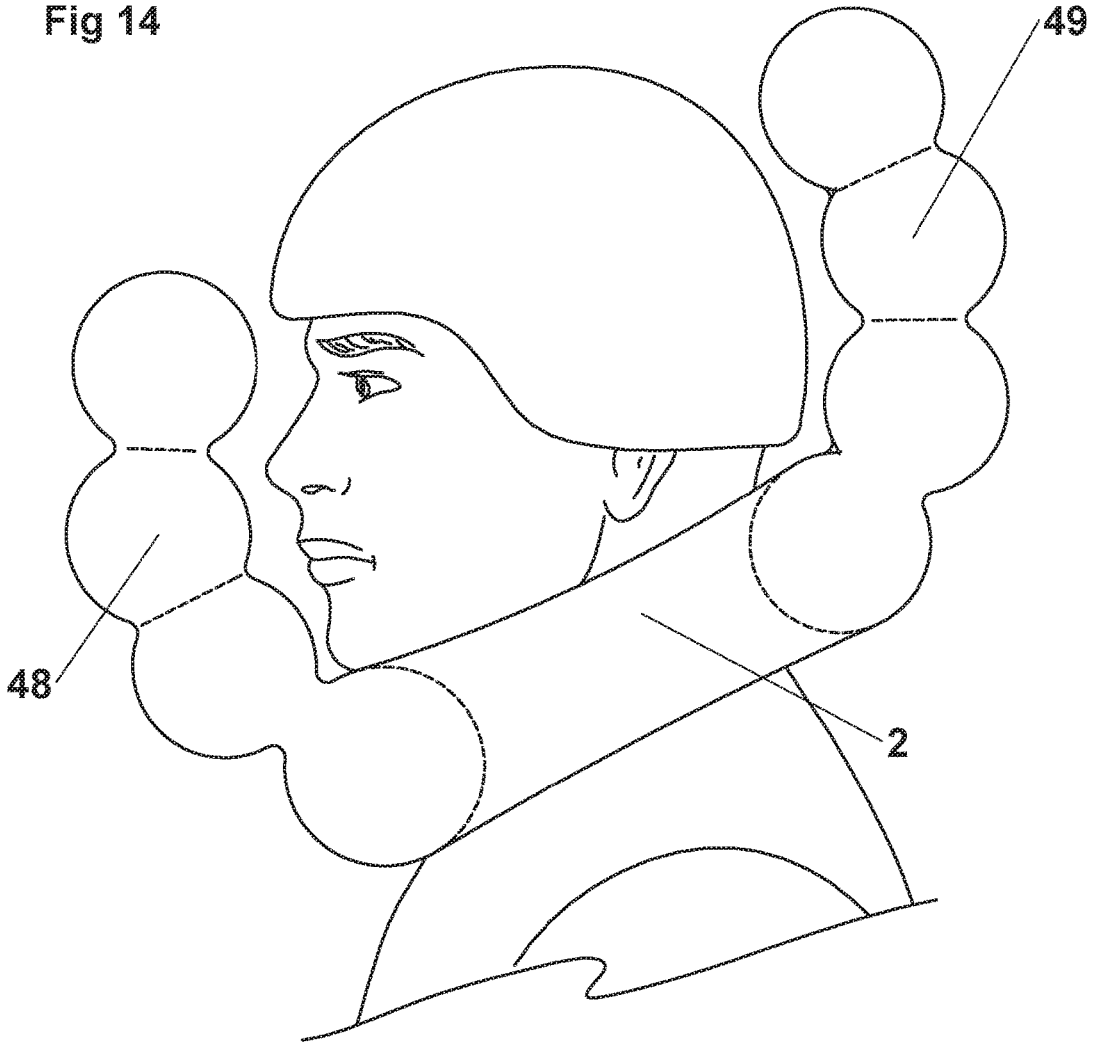
FIG. 14 depicts another embodiment of the cervical collar of the injury prevention device of FIG. 1, in the inflated state, as worn by a solider.

In some embodiments, as shown in FIG. 14, one or more inflatable chambers are added to the upper side of the inflatable cervical collar 2, creating one or more of: a face shield 48, an occipital shield 49 and side of the head shields. These may be separate shields or may be combined into one or two shields that may substantially wrap around the head of the soldier 50. The shields are designed to protect the head and face of the unconscious soldier 50 who is thrown to the ground or against a wall by the blast wind. Since being thrown to the ground is temporally the last mechanism of injury to occur, inflation of the shields 48, 49 can preferably be the last inflation event.

These inflatable shields 48, 49 are preferably in fluid communication with the inflatable chambers of the inflatable cervical collar 2. The fluid communication channels may regulate the flow of gases to assure that the cervical collar 2 chambers are substantially inflated before the shield chambers inflate. Alternately, the flow of gases may be regulated by including an openable membrane 34 in the fluid channel that ruptures when an adequate pressure is reached in the collar 2 chambers. Alternately, the gases may pass through one or more orifices or gas permeable fabrics to control the flow rate into the shield chambers. Other fluid flow control mechanisms are anticipated, including control mechanisms described herein with respect to other components of the disclosure.

In some embodiments, the shields 48 are made of materials and bonding techniques previously described for the inflatable cervical collar 2. The shield(s) 48, 49 may be made from the same or different fabrics or coatings than the inflatable cervical collar 2 since the purposes of the two components may be different. In some embodiments, the purpose of the shields 48, 49 is to physically protect the head during impact with a hard object like the ground. In contrast, the purpose of the cervical collar 2 may be to stabilize the neck during the violent blast wind phase and occlude the carotid arteries 40 and/or the jugular veins 42. For example, a durable fabric like Kevlar may be advantageously placed on the outer side of the shields 48 to mechanically protect the face and head from flying debris and from impact with the abrasive ground and walls.

In some embodiments, as shown in FIG. 7, the inflatable blast-induced brain injury prevention device 1 includes a base collar 52 surrounding all or a portion of the neck of the soldier 50. When the base collar 52 is being worn, it may rest on the soldier's shoulders and loosely surround the neck. In some embodiments, the base collar 52 includes a storage compartment for the deflated air chambers of the inflatable protection device 1. In this role, the base collar 52 is the functional equivalent to a parachute pack—it is meant to contain and protect the inflatable collars 2, 26, 28 in a folded configuration that allows inflation, deployment and unfurling without undesired tangling, twisting or encumbrance.

In some embodiments, the tubular base collar 52 may be made of fabric that wraps around the inflatable collars 2 and is openable along its entire upper surface. The two upper edges 54, 56 of the open tubular wrap may be approximated and held together around the upper circumference, by Velcro or adhesives that must automatically release when the inflatable collar 2 is inflated. The base collar 52 may also create a structure to which the electronic control unit 70 (e.g., ECU 70) and the inflator 72 may be anchored. The base collar 52 may be made of nylon or polyester fabric but any other suitable materials may be used, including but not limited to polymers, metallic foils, and composites.

In some embodiments, an electronic control unit 70 (ECU 70) or "trigger device 1" is attached to the base collar 52. The ECU 70 includes (e.g., is in electrical communication with) at least one sensor 74 in electrical connection with the ECU 70 for measuring air pressure (e.g., pressure sensor, air pressure sensor, a sensor that is indicative or can be correlated to air pressure). The instant invention is thus distinctly different than the ECU's 70 of the many airbag related inventions that protect against crashes and falls. The prior art relies on accelerometers and gyros to detect acceleration, deceleration or changes in attitude that are consistent with a crash or fall. The instant invention may "look" for one single triggering input—a sudden and massive increase in local atmospheric pressure, or another measurement correlating to atmospheric pressure. While the massive increase in atmospheric pressure is one exemplary embodiment for measurement, it must be understood that other measurements such as: sound pressure, sound pressure level (dB), sound power or sound energy and the like could be utilized for measurement and deployment and still be within the scope of this invention.

In some embodiments, for this protective device 1 to be practical for protecting a soldier 50 in combat, it should not inflate in response to loud sounds that are normal during combat conditions. Large-bore rifles, for example, produce sound pressure levels of 170-175 dB. 170 dB is approximately equal to 1 PSI. Howitzer crews can experience up to 5 PSI blast pressures when shooting their gun. Explosions such as LED's can produce blast wave pressures of up to 100 PSI (60-80 PSI is considered potentially Since "normal" combat noise can produce atmospheric pressures of up to 5 PSI, the preferred trigger threshold for the instant invention may include the detection of a blast wave pressure of approximately 10 PSI or greater. This threshold margin assures that "normal" combat noise will not trigger the device 1 but near-by explosions will. Alternatively, the range of trigger thresholds could be atmospheric pressures as low as 2 PSI and as high as 50 PSI or the equivalent levels of power or energy.

Since the blast wave is a wave of pressure that follows wave physics, the orientation of the wave to the at least one sensor 74 can have a significant influence on the detected pressure. For example, a sensor 74 facing the blast will sense a higher pressure than one on the other side of the soldier 50's neck facing the opposite direction. Similarly, sensors 74 oriented perpendicularly to the blast wave may also sense a lower pressure. In some embodiments this invention may have more than one pressure sensor 74 that may be spaced around the periphery of the base collar 52. Multiple pressure sensing locations increase the probability that at least one sensor 74 is optimally positioned relative to the pressure wave to detect the maximum pressure.

In some embodiments multiple sensors 74 may be used as a safety system to prevent accidental inflation of the collar 2 due to a single faulty sensor 74. For example, the ECU 70 may be programmed to require one of the sensors 74 to detect the "threshold" pressure of 10 PSI that is required to trigger the device 1. However, an algorithm or filter of the ECU 70 may be configured such that triggering cannot occur until a second sensor 74 simultaneously, or within a specified time range, detects a second lower atmospheric threshold pressure, like greater than 4 PSI for example. Requiring two or more sensors 74 to detect a blast wave prevents a single faulty pressure sensor 74 from accidentally triggering the device 1.

The prior art inflatable safety devices have to determine whether a sudden deceleration is a crash or hard braking or a pothole in the road, which is an analysis and decision-making process that requires multiple sensor 74 inputs and, therefore, takes a finite amount of time to sense and compute. Automobile airbag ECUs require approximately 15-30 milliseconds to analyze the inputs and trigger the initiator 76. In contrast, the ECU 70 of the instant invention may deploy the device 1 based only on increased atmospheric air pressure that exceeds a predetermined threshold—a simple binary decision with only one input measurement and no logic required. Therefore, the computing time required to sense and trigger the initiator 76 may be nearly instantaneous. The ECU 70 of the instant invention may require less than 5 milliseconds to analyze the inputs and trigger the initiator 76. In some embodiments deployment is only partially based on atmospheric air pressure with other contributing factors in the decision process. In some embodiments an algorithm, including a filtering algorithm or additional sensors 74 may be included in the decision, in conjunction with the atmospheric pressure exceeding a predetermined threshold.

In some embodiments, when the ECU 70 pressure sensor (s) 74 detects that the required atmospheric "threshold" pressure has been reached or exceeded, the ECU 70 may trigger the ignition of a gas generator propellant or pyrotechnic within the inflator 72 to rapidly inflate the inflatable chambers. An electrical current from the ECU 70 activates the initiator 76 or electric match, which ignites a solid propellant or pyrotechnic inside the inflator 72. The burning propellant or pyrotechnic generates inert inflating gases 58 that rapidly inflate the inflatable air chambers 4 in approximately 20-30 milliseconds. Suitable initiators, propellants and pyrotechnics, as are well-known in the automobile airbag arts, may be used.

Alternately, some airbag technologies that are also suitable for the instant invention use inflators including compressed nitrogen or argon gas with a pyrotechnic operated valve as the initiator 76 ("hybrid gas generators"). Other inflator 72 technologies that would also work with this invention use various energetic propellants including but not limited to cold and hot gas inflators that are also well described in the prior arts. Other inflation technologies are anticipated.

The basic inflation mechanisms for airbag safety devices have been well defined for decades. However, the triggering technology of the instant invention is fundamentally unique because it responds to the detection of the blast wave overpressure and not to deceleration or other movement indicating a crash.

In some embodiments, as shown in FIGS. 8-10, the ECU 70 is positioned at the front of the blast-induced brain injury prevention device 1, hanging down like a pendant on a necklace. From this location, the inflating gas 58 generated in the inflator 72 are vented first into the inflatable cervical collar 2. After the inflatable cervical collar 2 is inflated, the excess gases may be vented into the inflatable face collar 26 and the head collar 28.

In some embodiments, there is little or no need for computation and analysis and the trigger time of this device 1 may be less than 5 milliseconds. The inflation time of the relatively small inflatable chambers (compared to automobile airbags) may be 20 milliseconds or less. Therefore, the total time to full inflation after the blast wave may be less than 25 milliseconds. This is substantially faster than the 40-200 millisecond delay before the onset of the tertiary and indirect primary mechanisms of bTBI due to the blast. Therefore, all of the collars 2, 26, 28 of this inflatable blast-induced brain injury prevention device 1 should be fully inflated before the onset of the tertiary blast effects caused by the blast wind.

In some embodiments, deflation of the inflatable blast-induced brain injury prevention device 1 is a passive event. One or more small holes (e.g., vents) can be made in the wall of one or more of the inflatable collars 2 or chambers to allow inflation gases to leak out passively yet in a controlled manner. In some embodiments, deflation to 7atmospheric pressure occurs in less than 10 sec. although both longer and shorter times are anticipated. Therefore, by the time the soldier 50 regains consciousness, the inflatable blast-induced brain injury prevention device 1 will have deflated and will not be obscuring vision or occluding blood flow to the brain. Considering the extreme violence of the explosion and the events that follow, like being thrown through the air and landing head first on the hard ground, it is unlikely that the soldier 50 will even be aware that the inflatable blast-induced brain injury prevention device 1 inflated and deflated during the event.

In some embodiments, the ECU 70 includes a memory function that records the maximum blast pressure detected for later use in documenting the injury mechanism and for research purposes. In some embodiments, the ECU 70 also includes one or more accelerometers that also feed data into the memory function in order to document the effect of the blast on the soldier 50. The recorded blast intensity and acceleration may or may not be used for triggering the safety device 1 in conjunction with the air pressure measurement, but could also be used for diagnosis, documentation and research purposes.

Although the present disclosure is directed to embodiments including a device 1 worn around the neck, the features pertaining to sensing and triggering of the device 1 based on atmospheric air pressure may be used in conjunction with other protective devices, such as other inflatable air chamber 4 based protective devices, or other safety devices, including but not limited to, seatbelt-type devices.

It should be understood that this invention is not limited to the illustrative embodiments set forth herein. Whereas particular embodiments of the invention have been described herein for the purposes of illustration, it will be evident to those skilled in the art that numerous variations, combinations and modifications of the details may be made without departing from the invention as set forth in the appended embodiments.

The invention claimed is:

1. An inflatable blast-induced brain injury prevention device for combat soldiers, the device comprising:

one or more inflatable chambers that cooperate to form a substantially toroidal cervical collar configured to surround the soldier's neck;

an inflator unit coupled to the one or more inflatable chambers to inflate the one or more inflatable chambers;

an initiator configured to activate the inflator unit; and an electronic control unit (ECU) in electrical communication with the initiator, the ECU in electrical communication with at least one sensor configured to measure atmospheric air pressure, the electronic control unit programmed to activate the initiator when the measured air pressure exceeds a threshold air pressure.

2. The inflatable blast-induced brain injury prevention device of claim 1, further comprising a base collar that includes a storage compartment to house and store the one or more inflatable air chambers in a deflated state.

3. The inflatable blast-induced brain injury prevention device of claim 1, wherein the inflatable air chambers of the cervical collar expand upward when inflated and thereby configured to engage at least the underside of the soldier's jaw and occiput.

4. The inflatable blast-induced brain injury prevention device of claim 1, wherein the inflatable chambers form a tubular chamber extending from a first end to a second end, the first and second ends coupled together at a location that is configured to be located proximate the front of the soldier's neck when worn.

5. The inflatable blast-induced brain injury prevention device of claim 1, wherein when the device is configured to be placed around the neck of a soldier and the inflatable chambers are inflated, a vertical "V-shaped" depression is created adjacent the soldier's trachea and larynx to minimize the lateral pressure applied to the trachea and larynx.

6. The inflatable blast-induced brain injury prevention device of claim 1, wherein the cervical collar includes fabric partitions or cords within the one or more of the inflatable chambers of the tubular collar, the fabric partitions or cords are attached to opposing sides of the inflatable chamber to convert the inflatable chamber in the inflated state, from a round cross section to a substantially oval cross sectional shape.

7. The inflatable blast-induced brain injury prevention device of claim 6, wherein when the cervical collar is inflated, a vertical oval cross sectional shape of one or more of the one or more inflatable chambers is created and thereby configured to be adjacent the soldier's trachea and larynx, to minimize the lateral pressure applied to the trachea and larynx.

8. The inflatable blast-induced brain injury prevention device of claim 6, wherein the one or more inflatable chambers having a rounded or horizontal oval cross sectional shape is configured to be adjacent the antero-lateral aspects of the neck for maximizing pressure applied to the soldier's carotid arteries when inflated.

9. The inflatable blast-induced brain injury prevention device of claim 1, wherein the cervical collar has a first surface configured to face the neck of the soldier when the cervical collar is inflated around the neck of a solider, the first surface having occlusive members thereon configured to compress the soldier's neck proximate the soldier's carotid artery to provide additional compression of the arteries when inflated.

10. The inflatable blast-induced brain injury prevention device of claim 1, wherein the occlusive members are elongate ridge-shaped occlusive members.

11. The inflatable blast-induced brain injury prevention device of claim 1, wherein the one or more inflatable chambers cooperate to form a substantially toroidal face collar that, when inflated, is thereby configured to surround the soldier's head and face, above and substantially parallel to the toroidal cervical collar.

12. The inflatable blast-induced brain injury prevention device of claim 1, wherein the one or more inflatable chambers cooperate to form a substantially toroidal head collar that is configured to surround the soldier's head, above and substantially parallel to the toroidal face collar.

13. The inflatable blast-induced brain injury prevention device of claim 1, wherein at least one of the one or more inflatable chambers is in fluid communication with another inflatable chamber through a plenum located at the back of the collar.

14. The inflatable blast-induced brain injury prevention device of claim 1, wherein at least two of the one or more inflatable chambers are in fluid communication with each other through interconnecting channels located at one or more locations around the toroidal collar.

15. The inflatable blast-induced brain injury prevention device of claim 1, wherein the one or more inflatable chambers, in the inflated state, form one or more of: a face shield, an occipital shield, sides of the head shields, or any combination thereof, when inflated about the soldier's neck.

16. The inflatable blast-induced brain injury prevention device of claim 14, wherein the one or more shields cooperate to form a protective shield that is configured to substantially surrounds the soldier's head.

17. The inflatable blast-induced brain injury prevention device of claim 1, wherein the electronic control unit activates the initiator when the air pressure sensor detects a rise in air pressure to a predetermined threshold pressure of 5 PSI or greater.

18. The inflatable blast-induced brain injury prevention device of claim 1, wherein the electronic control unit activates the initiator when the air pressure sensor detects a rise in air pressure to a predetermined threshold pressure in the range of 2 PSI to 50 PSI.

19. The inflatable blast-induced brain injury prevention device of claim 1, wherein the electronic control unit activates the initiator when the air pressure sensor detects a predetermined threshold of one of the following parameters: sound pressure, sound pressure level (dB), sound power or sound energy levels that are equivalent to threshold pressure levels in the range of 2 PSI to 50 PSI.

20. The inflatable blast-induced brain injury prevention device of claim 2, wherein the electronic control unit includes more than one air pressure sensor, the air pressure sensors spaced apart on the base collar to detect the maximal air pressure wave approaching from any direction.

21. The inflatable blast-induced brain injury prevention device of claim 20, wherein the electronic control unit requires the detection of the blast overpressure by at least two of the air pressure sensors before activating the initiator.

22. The inflatable blast-induced brain injury prevention device of claim 1, wherein the inflator unit includes a gas generator propellant or pyrotechnic to rapidly inflate the inflatable chambers with inert gas.

23. The inflatable blast-induced brain injury prevention device of claim 1, wherein the electronic control unit includes a memory function configured to record the maximum blast pressure for documentation, analysis and research.

24. The inflatable blast-induced brain injury prevention device of claim 1, wherein the electronic control unit includes at least one accelerometer and a memory function configured to record the movement of the solider caused by the blast for documentation, analysis and research.

25. The inflatable blast-induced brain injury prevention device of claim 1, wherein the device is configured to detect a blast overpressure wave that exceeds a predetermined threshold pressure, trigger inflation and then inflate the inflatable chambers to stabilize and protect a soldier's head and neck in less than 50 milliseconds.

26. An inflatable injury prevention device for protecting a living being from external factors such as blast kinematics from an explosion, the device comprising:

one or more inflatable chambers;

an inflation device coupled to the one or more inflatable chambers;

a sensor configured to measure atmospheric air pressure or a value indicative of atmospheric pressure;

an electronic control unit (ECU) including a processor in electrical connection with the sensor and the inflation device, the ECU configured to receive measured atmospheric air pressure data from the sensor and determine if an atmospheric air pressure threshold has been exceeded, and, if the atmospheric air pressure threshold has been exceeded, to initiate the inflation device to inflate at least one of the one or more inflatable chambers.

27. The device of claim 26, wherein the one or more inflatable chambers form a cervical collar that is configured to surround at least a portion of a neck of the living being.

28. The device of claim 27, further comprising a base collar having a storage compartment to store the deflated inflatable air chambers of the cervical collar, wherein the inflatable air chambers expand upward and away from the base collar when inflated is configured to engage at least the underside of the living being's jaw and occiput.

* * * * *